United States Patent [19]

Dreher

[11] 4,073,095

[45] Feb. 14, 1978

[54] CENTRIFUGAL DRUM POLISHING MACHINE

[76] Inventor: Manfrid Dreher, Haupstr. 74, 7543 Engelsbrand, Germany

[21] Appl. No.: 759,839

[22] Filed: Jan. 17, 1977

[30] Foreign Application Priority Data

Jan. 21, 1976 Germany ..... 2602055

[51] Int. Cl.[2] ..... B24B 31/04

[52] U.S. Cl. ..... 51/164; 233/25

[58] Field of Search ..... 51/164, 163.2; 233/25

[56] References Cited

U.S. PATENT DOCUMENTS

| | | | |
|---|---|---|---|
| 489,202 | 1/1893 | Peck | 233/25 |
| 3,422,577 | 1/1969 | McKibben | 51/163.2 |
| 3,524,735 | 8/1970 | Oetiker | 51/164 |
| 3,609,921 | 10/1971 | Foster | 51/164 |
| 3,855,740 | 12/1974 | Kobayashi | 51/164 |

*Primary Examiner*—Harold D. Whitehead
*Attorney, Agent, or Firm*—Olsen and Stephenson

[57] ABSTRACT

Apparatus for grinding and polishing small parts which is of the centrifugal drum polisher type, said apparatus including a stationary support, a rotor mounted on the support, and a plurality of drum containers mounted on the rotor and in frictional engagement with the stationary support so that the drum containers will rotate in response to rotation of the rotor.

5 Claims, 2 Drawing Figures

CENTRIFUGAL DRUM POLISHING MACHINE

BACKGROUND OF THE INVENTION

The invention concerns a centrifugal drum polishing machine for the simultaneous surface treatment of small parts, e.g. grinding and polishing, with at least two drum containers of pot-like design which can be closed with a cover and contain the small parts and treatment medium, the drum containers being mounted in vertical position on a rotor which is mounted on a stationary support and can be driven in rotation around vertical axis, and being at the same radial distance from the axis of rotation of the latter and being drivable in rotation around their own axes during rotation of the rotor.

A centrifugal drum polisher of the above type, by means of which a considerably higher grinding performance can be realized compared to conventional drum machines, is already known, as is disclosed, for example, in U.S. Pat. No. 3,524,735.

SUMMARY OF THE INVENTION

The object of the present invention is to provide a particularly simple and functionally reliable independent drive of the drum containers for such centrifugal drum machines.

This object is realized by the invention by the fact that the drum containers form a positive friction contact directly or indirectly with the running surface of the support arranged coaxially with respect to the axis of rotation of the rotor. This design makes it unnecessary to use the conventional intermediate drive member for each drum container in these machines, generally consisting of a belt which encloses a stationary belt pulley assigned to each drum container and placed coaxially with respect to the rotor axis as well as a fixed belt pulley located on the shaft of the respective drum container.

The drum containers may contact the support running surface directly with a circumferential part. However, a more favorable design can be obtained if an impeller with torsional resistance is mounted on the bearing shaft of the drum container and rolls off the running surface. A particularly suitable design is obtained if the running surface is formed by the internal circumferential surface of a contact ring located on the support and if the rotor has the design of an inverted dish, and if impellers are mounted with torsional resistance on the bearing shafts of the drum containers within the internal space defined by the support contact ring and the rotor.

In order to obtain a sufficient friction contact between the impellers and the internal circumferential surface of the contact ring, it is recommended to provide the impellers with an elastically flexible cover, especially a rubber or elastomeric ring, on the outside circumference and to select the radial distance between the internal circumferential surface of the contact ring and the circumferential surface of the cover in such a way that the latter contacts the contact ring at a certain pressure. In one inversion of the invention, the rotor is mounted in torsionally fixed position on the shaft of the drive motor installed on the underside of the support. In a further improvement, the support forms the false bottom of a housing, accessible from the top, which surrounds the rotor and drum container, its open side being closable preferably by a cover which disconnects the current of the drive motor in lifted position, so that the machine can not be started as long as the housing is not completely closed.

In a further favorable improvement of the invention, the design is made such that no special mounting of the drum containers on the rotor is necessary for drum operation. This is possible if the drum containers are designed as cylinders which have a cross-section different from a circular form and can be closed at their front face, and which can be inserted with a fairly large radial clearance into holding containers which are rotatably supported in the rotor and have a cross-sectional form adapted to the cross-section of the cylindrical drum containers, an impeller being located on the bearing shaft of the holding containers and making contact with the running surface. The non-circular cross-section of the drum and holding containers thus affords a reliable entrainment of the drum containers in order to place them into rotation around their axes, while the radial clearance between drum and holding containers assures that the former will not climb upward and out of the holding containers by repeated tilting during operation of the centrifugal drum polisher and thus can not be projected into the housing. Tests have shown that is only a very small radial clearance is present between drum and holding containers, any slight tilting of the drum containers in the holding containers regularly leads to climbing of the drum containers in the holding containers, so that the drum containers are finally expelled from the latter.

In a further favorable improvement of the invention, the inside of the drum container bottom finally forms a dome-shaped depression, which results in a considerably improved material flow along the drum wall surface in the upward direction and thus in a generally satisfactory movement and thus mixing of the charge, which in turn is reflected in a more uniform deburring result.

Other objects of this invention will appear in the following description and appended claims, reference being had to the accompanying drawings forming a part of this specification wherein like reference characters designate corresponding parts in the several views.

DESCRIPTION OF THE PREFERRED EMBODIMENT

Figure 1:
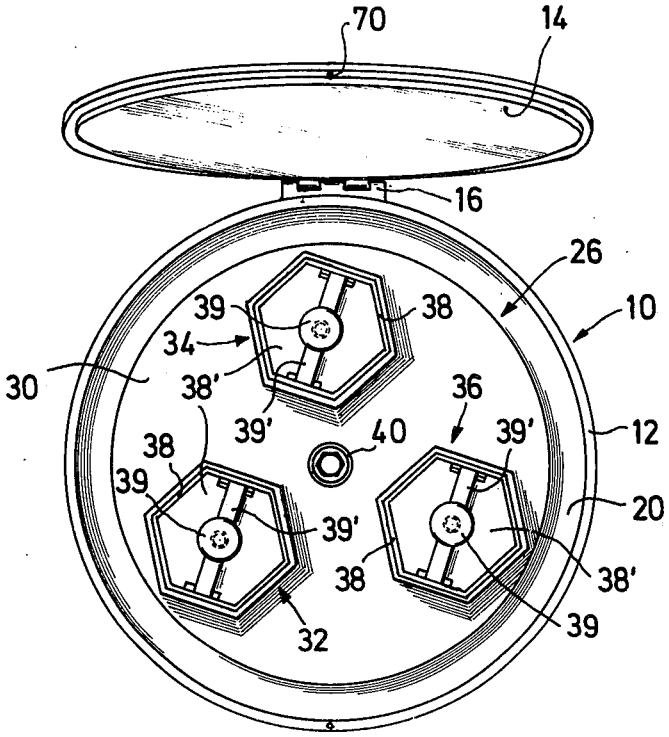
FIG. 1 is a top view of the centrifugal drum polishing machine, embodying one form of the invention, showing the machine with the housing cover in an open position.

Before explaining the present invention in detail, it is to be understood that the invention is not limited in its application to the details of construction and arrangement of parts illustrated in the accompanying drawings, since the invention is capable of other embodiments and of being practiced or carried out in various ways. Also, it is to be understood that the phraseology or terminology employed herein is for the purpose of description and not of limitation.

The entire unit of a housing with access from the top and with a circular cross-section, for example, is identified by 10 with a cover 14 being articulated with its open top part 12 by means of hinge 16 in order to close this cover. The top housing part 12 is separated from the bottom housing part 18 by a horizontal false bottom 20. The lower housing part 18, in the zone of its lower edge, has an inside flange 22, for example, with props 24 being mounted on its underside at an angular distance from each other for the purpose of installation of the centrifugal drum machine. False bottom 20 serves as the support of a drum aggregate designed as a unit by 26, consisting of a drive motor 28, a rotor 30 and three holding containers 32, 34, 36 in each of which a removable drum container 28 is located. During operation of the centrifugal drum machine, rotor 30 and holding containers 32, 34, 36 rotate around vertical axes. In this process, rotor 30 is mounted with boss 40 on a driven shaft 42 of drive 44 of the drive motor 28, bolted to the underside of the support-forming false bottom 20, so that the drive motor together with its respective motor brake 46 is located in the lower housing part 18. The rotor has the form of an inverted dish and has a total of three bearing bosses 48 in which the respective holding container is mounted with its bearing shaft 54 by means of ball bearings 50, 52, so as to be freely rotatable, an impeller 56 being mounted with torsional resistance on the lower end of the bearing shaft projecting from boss 48 and carrying an elastic ring, particularly a rubber ring 58 on its circumference. At the top side of false bottom 20, coaxial to the axis of rotation of rotor 30, a contact ring 60 is provided, which may be molded on it, and which has an internal curcumferential surface 62 of curcular-cylindrical shape as the running surface. The rubber rings 58 of impellers 56 contact this internal circumferential surface under pressure. An electrical switch located on the circumference of the lower housing part 18 in a depressed wall part 66 is designated by 64 as a unit, the operation of which allows starting of the drive motor 28. The latter drives rotor 30, during whose rotation the holding containers 32, 34, 36 for drum containers 38 move along a circular path. Because the impellers 56 are forced to roll on the running surface 62 of contact ring 60 during this process, the holding containers are placed into rotation around their own axes. Thus, they perform self-rotation during rotation of the rotor. This increases the centrifugal force acting on the charge and thus the grinding pressure in drum containers 38. In the zone of the upper edge of upper housing part 12, a safety switch 68 is provided which can be operated by an actuating button 70 of cover 14 shown in closed position in FIG. 2. As long as cover 14 is in closed position, the circuit driving the drive motor 28 remains closed and the drum polishing machine remains in operation for a predetermined adjustable time. However, if cover 14 is opened, the circuit is disconnected by safety switch 68, so that inadvertent operation of switch 64 can not start the machine when the housing is open.

Figure 2:
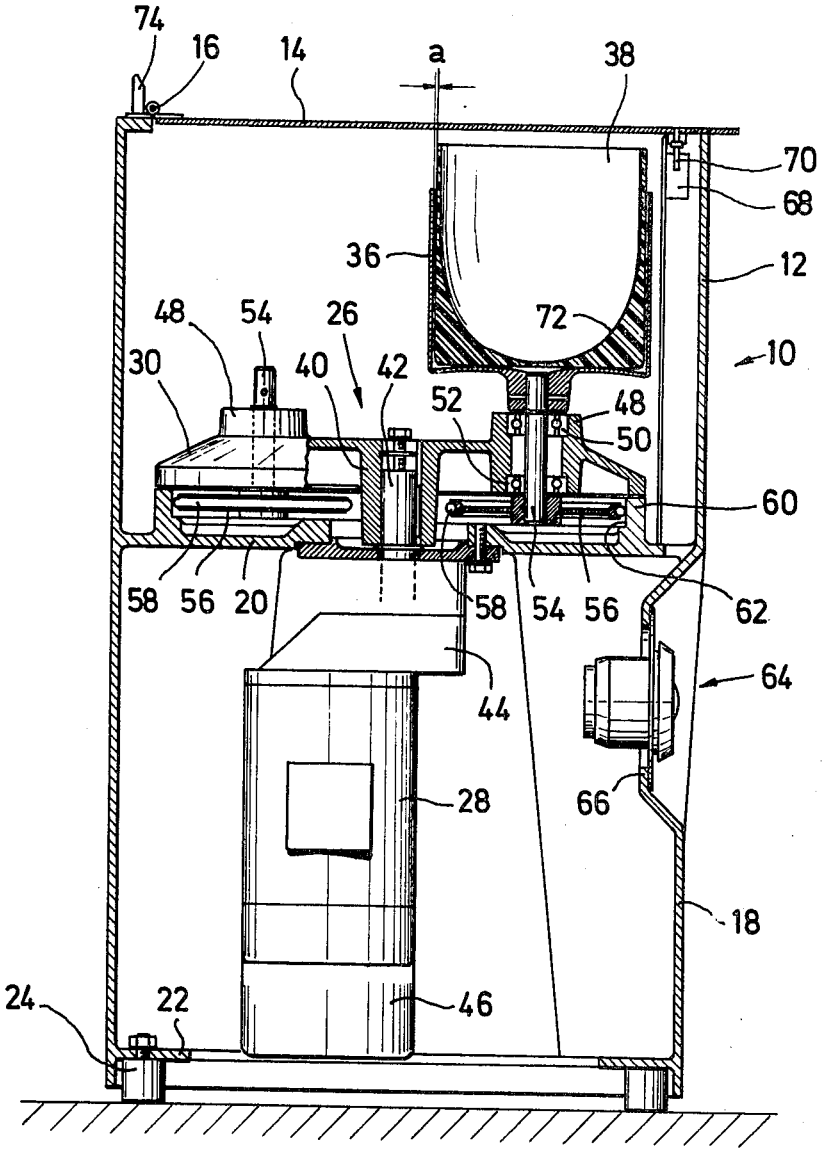
FIG. 2 is a longitudinal section of the centrifugal drum polishing machine.

As is clearly evident in FIG. 1, the holding containers 32, 34, 36 are designed as polygon cylinders, preferably in hexagonal form. In their rotational motion, this design assures entrainment of the drum containers 38 having the same cross-section. The latter must simply be inserted from the top into the pot-like holding containers but do not need to be specifically mounted therein. As is clearly shown in FIG. 2, a fairly large radial play *a* is provided between the wall of the holding containers and the drum containers, which effectively prevents upward travel of the drum containers 38 during operation of the centrifugal drum polisher. In FIG. 2, the drum containers are shown open, while in FIG. 1, they are closed with a cover 38' which can be reliably tightened on the holding container without leaks by means of a tightening device 39' operated with handwheel 39.

FIG. 2 clearly shows the design of the inside bottom surface 72 of the drum containers, which exhibits an inverted dome shape favoring transport of the charge along the inside wall of the drum containers in upward direction during operation of the centrifugal drum polishing machine.

The upper edge of housing top part 12 behind cover hinge 16 is provided with a stop 74, by means of which the cover is prevented from falling back in its open position.

It is claimed:

1. A centrifugal drum polishing machine for simultaneous surface treatment of small parts, such as grinding and polishing by use of a treatment medium, comprising a stationary support, a rotor mounted on said stationary support for rotation around a vertical axis, and a plurality of drum containers of pot-like configuration which are adapted to be closed by covers and to contain the small parts and treatment medium, said drum containers being mounted on said rotor with their axes in vertical positions at the same radial distance from the axis of rotation of said rotor, each drum container being mounted for rotation about its own axis, said support having a running surface arranged coaxially to the axis of said rotor, and said drum containers being in a friction-drive relationship with said running surface for the purpose of rotating the drum containers in response to rotation of said rotor, said support having a contact ring encircling said axes and said running surface being the inside circumferential surface thereof, said rotor having the shape of an inverted dish with its outer periphery overlying said contact ring in close relationship so that an enclosure is provided by said support and said rotor, and said drum containers being supported on shafts which extend into the enclosure defined by said support and its contact ring and by said rotor, said frictional drive relationship being provided by an impeller on each shaft in frictional engagement with said running surface, and a drive motor mounted on the underside of said support, said drive motor having a drive shaft extending through said support into said enclosure and on which said rotor is mounted for rotation therewith.

2. The centrifugal drum polishing machine that is defined in claim 1, wherein each of said impellers carries an elastomeric ring around its outer circumference for making said frictional engagement with said running surface.

3. The centrifugal drum polishing machine that is defined in claim 1, wherein a housing is provided and said support is a false bottom thereof, the false bottom and the portion of said housing above said false bottom surrounding said rotor and said drum containers.

4. The centrifugal drum polishing machine that is defined in claim 1, wherein said rotor has a plurality of rotatable shafts located respectively on said axes, and a plurality of holding containers in which said drum containers are carried for their rotational movement about their axes, said drum containers having generally cylindrical configurations adapted to be closed at their tops and have horizontal cross sections that are non-circular, and said holding containers have cross sections corresponding in shape to the cross sectional shapes of said drum containers and of radial dimensions sufficiently larger than said drum containers to provide clearances therebetween while requiring corotation thereof.

5. The centrifugal drum polishing machine that is defined in claim 4, wherein the inside bottom walls of the drum containers have inverted dome shapes.

* * * * *